US008272403B2

(12) United States Patent
Stallmann

(10) Patent No.: US 8,272,403 B2
(45) Date of Patent: Sep. 25, 2012

(54) VALVE PART OF A HYDRAULIC CONTROL VALVE

(75) Inventor: John Stallmann, Washington, MI (US)

(73) Assignee: Schaeffler Technologies AG & Co. KG, Herzogenaurach, (DE)

( * ) Notice: Subject to any disclaimer, the term of this patent is extended or adjusted under 35 U.S.C. 154(b) by 842 days.

(21) Appl. No.: 12/175,587

(22) Filed: Jul. 18, 2008

(65) Prior Publication Data

US 2009/0020178 A1 Jan. 22, 2009

Related U.S. Application Data

(60) Provisional application No. 60/950,470, filed on Jul. 18, 2007.

(51) Int. Cl.
*F16K 11/07* (2006.01)

(52) U.S. Cl. ..... 137/625.69; 251/50; 251/325; 138/40

(58) Field of Classification Search ..... 137/625.65, 137/625.66, 625.68, 625.69, 625.2, 625.27; 251/48, 50, 325; 138/40
See application file for complete search history.

(56) References Cited

U.S. PATENT DOCUMENTS 4,167,262 A * 9/1979 Lemmon ..... 251/25
4,669,504 A * 6/1987 Fujitsugu et al. ..... 137/625.65
4,887,643 A * 12/1989 Tomlin et al. ..... 137/625.66
5,507,316 A * 4/1996 Meyer ..... 137/625.65
5,984,259 A * 11/1999 Najmolhoda et al. ..... 251/50
2006/0016495 A1* 1/2006 Strauss et al. ..... 137/625.65
2006/0231147 A1* 10/2006 Pride et al. ..... 137/625.64

FOREIGN PATENT DOCUMENTS

DE 10239207 3/2004
EP 1596041 11/2005

* cited by examiner

*Primary Examiner* — Craig Schneider
*Assistant Examiner* — Ian Paquette
(74) *Attorney, Agent, or Firm* — Volpe and Koenig, P.C.

(57) ABSTRACT

A valve part of a hydraulic control valve for controlling flows of pressurized medium is provided. The valve part includes: a cylindrical valve housing with a valve housing hollow space that is open on one side in the axial direction, wherein the valve housing is provided with a radial first work connection (A), a radial second work connection (B), and a radial pressure connection (P), each of which opens into the valve housing hollow space, and a cylindrical control piston is held in the valve housing hollow space so that it can move in the axial direction with a control piston hollow space that is open on one side at an axial control piston hollow space opening. The control piston is provided with a radial discharge connection (T) opening into the control piston hollow space, and the control piston is constructed in such a way that the work connections (A, B) can be connected selectively in a fluid conducting way to the pressure connection (P) and the discharge connection (T) through axial displacement of the control piston. The valve part distinguishes itself in that a cover provided with at least one cover opening is attached to the axial control piston hollow space opening.

9 Claims, 3 Drawing Sheets

VALVE PART OF A HYDRAULIC CONTROL VALVE

CROSS-REFERENCE TO RELATED APPLICATIONS

This application claims the benefit of U.S. Provisional Appln. No. 60/950,470, filed Jul. 18, 2007, which is incorporated herein by reference as if fully set forth

BACKGROUND

The invention relates to the technical field of control valves and relates, according to its class, to a valve part of a control valve activated by an actuator for controlling flows of pressurized medium.

In internal combustion engines, gas-exchange valves are activated by the cams of a camshaft set in rotation by the crankshaft, wherein, through the arrangement and shape of the cams, the control times of the gas-exchange valves can be set in a selective way. From the background of thermodynamic processes, it has proven advantageous if, during the operation of the internal combustion engine, the control times of the gas-exchange valves are influenced as a function of the current operating state of the engine, such as rotational speed or load. This influence is set by the relative rotational position between the cam and crankshaft. The use of devices for changing and fixing the relative rotational position between the camshaft and crankshaft, generally designated as "camshaft adjusters," has been known for a long time.

Camshaft adjusters typically comprise a drive part locked in rotation with the crankshaft via a drive wheel and a driven part fixed to the camshaft, as well as a hydraulic control drive, which is connected between the drive part and driven part and which transmits the torque from the drive part to the driven part and allows a fixing and also adjustment of the relative rotational position between the drive part and driven part.

Hydraulic camshaft adjusters are typically constructed as axial piston adjusters or rotary piston adjusters. For an axial piston adjuster, the drive part engages with a piston through the use of helical gearing. This piston engages, on one side, with the driven part by helical gearing. Between the drive part and driven part, a pressure space is formed, which is divided by the piston into two pressure chambers. For a rotary piston adjuster, the drive part constructed in the form of an external rotor ("stator") and the driven part constructed in the form of an internal rotor ("rotor") are arranged concentrically and adjustable in rotation relative to each other. Pressure spaces are formed in the radial intermediate space between the stator and rotor. A vane connected to the rotor extends into each of these pressure spaces, by which each pressure space is divided into two pressure chambers. Through selective pressurization of the pressure chambers of each pressure space, that is, by generating a pressure difference across the pressure chamber pair of each pressure space, the drive part can be moved relative to the driven part, so that a rotation of the camshaft and consequently a change in the relative rotational position between the camshaft and crankshaft is created. On the other hand, the relative rotational position can be maintained through a corresponding equal pressurization of the two pressure chambers of a pressure space.

Controlling the hydraulic camshaft adjuster is realized by a control unit, which controls the feed and discharge of pressurized medium to and from the individual pressure chambers based on detected characteristics of the internal combustion engine. The flows of pressurized medium are regulated by a control valve (proportional valve) controlled by the control unit.

Control valves for controlling the flows of pressurized medium for camshaft adjusters have been known as such for a long time and are described, for example, in the European Patent Application EP 1 596 041 A1 and the German Offenlegungsschrift [unexamined patent application] DE 102 39 207 A1 of the applicant. They comprise, as essential components, an actuator, typically an electromagnet with a hollow cylindrical magnetic housing, in whose hollow space a coil winding and an axially moving magnetic armature are arranged with a tappet, as well as a hydraulic valve part with a hollow cylindrical valve housing, in whose hollow space a control piston that can move in the axial direction is held. When the magnetic armature is energized, the tappet acts on the control piston of the valve part, so that this piston can be displaced in the axial direction against the pressure force of a compression spring, in order to regulate the flows of pressurized medium in this manner.

In a typical construction, the valve housing is provided on its outer periphery with a plurality of annular grooves that are spaced apart in the axial direction and in which radial boreholes are machined. These boreholes open into the hollow space of the valve housing and are used as a pressure connection work connections. The control piston can be provided in the form of a hollow piston with a hollow space, which is open on one side and whose opening is used as a discharge connection. If the hollow space opening of the control piston is located on the end away from the tappet, then it can be formed as an axial opening. If the hollow space opening of the control piston is located on the end facing the tappet, then in general it is necessary to form this opening as a radial opening, in order to provide a sufficient contact surface on the control piston for the tappet. An example construction of such a valve part is shown in FIG. 5.

Accordingly, the valve part designated as a whole with the reference number 100 of an electromagnetic control valve comprises a hollow cylindrical valve housing 101, which surrounds a valve housing hollow space 103 with an axial hollow space opening 121. In the valve housing hollow space 103, a control piston 102 is held so that it can move in the axial direction. A tappet 104, which is only shown partially and which is attached rigidly to a magnetic armature of an electromagnet not shown in FIG. 5, contacts the end face 105 of the control piston 102 at the left in FIG. 5. When the magnetic armature is energized, the tappet is displaced in the axial direction relative to the valve part 100 and in this way displaces the control piston 102 against the spring force of a compression spring 106. On one end, the compression spring 106 contacts the end of the control piston 102 away from the tappet and for this purpose is held in an axial first ring step 107. On its other end, the compression spring 106 is supported on a first end face 109 oriented perpendicular to the axial direction of an axial second ring step 108 of the valve housing hollow space 103.

The valve housing 101 is provided on its outer periphery with three ring grooves, namely a first ring groove 123, a second ring groove 124, and a third ring groove 125, spaced apart in the axial direction. In the ring grooves, first radial boreholes 110, second radial boreholes 111, and third radial boreholes 112 are machined uniformly about the periphery, which each open into the valve housing hollow space 103. In the shown axial section, the ring grooves transition directly into the radial boreholes, so that they are not distinguished from the ring grooves in the drawing. As indicated by the arrows, the first ring groove 123 with the first radial boreholes 110 acts as a first work connection A, the second ring groove 124 with the second radial boreholes 111 acts as a pressure connection P, and the third ring groove 125 with the third radial boreholes 112 as a second work connection B.

The control piston 102 is constructed in the form of a hollow piston, wherein the control piston hollow space 118 is formed by a blind borehole open toward the first end face 109 of the valve housing with an axial end face 127. In the outer periphery of the control piston 102, three ring grooves are machined, namely a fourth ring groove 114, a fifth ring groove 115, and a sixth ring groove 113 located between the fourth and fifth ring groove. The fourth ring groove 114 is provided with fourth radial boreholes 116 distributed uniformly about the periphery and the fifth ring groove 115 is provided with fifth radial boreholes 117, which are distributed uniformly about the periphery and which each open into the control piston hollow space 118. Furthermore, the control piston 102 is provided on its tappet-side end section with sixth radial boreholes 119, which are arranged distributed about the periphery and which connect the control piston hollow space 118 with a twice offset, axial third ring step 120 in a fluid-conducting manner, which opens into the hollow space opening 121 of the valve housing 101. The hollow space opening 121 is used as a discharge connection T. Adjacent to the sixth ring groove 113 are a first ring bar 122 and a second ring bar 128, whose peripheral surfaces are shaped so that for an axial displacement of the control piston 102, the first and the third radial boreholes 110, 112 can be covered and opened, in order to regulate the flow rate of pressurized medium in this way by changing the cross sections of the openings.

Thus, according to the axial position of the control piston 102, the first work connection A and the second work connection B can be connected in a fluid-conducting manner selectively with the pressure connection P or the tank connection T. In FIG. 5, a situation is shown, in which the first work connection A is connected to the tank connection T, while the second work connection B is connected to the pressure connection P.

If pressurized medium flow into the control piston hollow space 118 (as specified by the dashed arrows), the flows of pressurized medium directed inward in the radial direction are deflected into an axial flow of pressurized medium, which is directed toward the tappet-side end of the control piston hollow space 118 and which flows essentially in the middle of the control piston hollow space 118. Then the axial flow of pressurized medium is deflected into flows of pressurized medium directed outwardly in the radial direction, which are diverted into the discharge connection T.

When the flows of pressurized medium directed inwardly in the radial direction and flowing into the control piston hollow space 118 are deflected into an axial flow of pressurized medium, an axial pressure force is exerted by the pressurized medium on the first end face 109 of the valve housing 101, as indicated in FIG. 5 by the arrows (directed toward the right). Through the resulting reaction force, the control piston 102 is pressed in one direction, which is equal to the direction of the spring force of the compression spring 106 (to the left in FIG. 5). If the axial flow of pressurized medium strikes the second end face 127 of the control piston hollow space 118 of the control piston 102, a build-up pressure is exerted by the axial flow of pressurized medium on the second end face 127, which loads the control piston 102 in a direction that is in the same direction as the spring force of the compression spring 106 (to the left in FIG. 5).

Consequently, these effects lead to an imbalance in the pressure forces primarily in the middle of the control piston 102, with these forces generating the undesired force curves for the desired axial displacements of the control piston 102. In addition, the tappet 104 activated by the electromagnet must shift the control piston 102 against a higher resistance, so that the electromagnet must have a sufficiently robust construction, in order to withstand an increased heat generation for the higher current intensities necessary for this purpose.

SUMMARY

Accordingly, the object of the invention involves making available a valve part of an electromagnetic control valve for regulating flows of pressurized medium, through which the disadvantages named above and occurring with a deflection of the flows of pressurized medium directed inwardly in the radial direction into an axial flow of pressurized medium can be avoided.

This and other problems will be solved according to the invention by a valve part of a hydraulic control valve for controlling flows of pressurized medium, in particular, for a hydraulic camshaft adjuster of an internal combustion engine, with the features of the invention. Advantageous constructions of the invention are specified by the features of the invention described below.

According to the invention, a valve part of a hydraulic control valve is shown for controlling flows of pressurized medium, wherein this valve is used, in particular, for controlling flows of pressurized medium of a hydraulic camshaft adjuster.

The valve part comprises a (hollow) cylindrical valve housing with a first cylinder casing section extending in the axial direction (relative to the valve longitudinal direction or cylindrical axis) and a first cylinder base section extending perpendicular to the axial direction. The first cylinder casing section and the first cylinder base section together bound a hollow space of the valve housing open to one side. The first cylinder casing section is provided with a first (radial) work connection (A), which can be constructed, for example, in the form of a ring groove with machined radial openings, which open into the valve housing hollow space. The first work connection (A) is provided, for example, for connecting to one of the two pressure chambers of a pressure space of a hydraulic camshaft adjuster. The first cylinder casing section is further provided with a (radial) second work connection (B), which can be constructed, for example, in the form of a ring groove with machined radial openings, which open into the valve housing hollow space. The second work connection (B) is provided, for example, for connecting to the second of the two pressure chambers of a pressure space of a hydraulic camshaft adjuster. In addition, the first cylinder casing section is provided with a (radial) pressure connection (P), which can be constructed, for example, in the form of a ring groove with machined radial openings, which open into the valve housing hollow space. The pressure connection (P) is provided, for example, for connecting to a pressurized medium pump. The first work connection (A), the second work connection (B), and the pressure connection (P) each open into the valve housing hollow space.

The valve part further comprises a cylindrical control piston held in the valve housing hollow space so that it can move in the axial direction with a second cylinder casing section extending in the axial direction and a second cylinder base section extending perpendicular to the axial direction. The second cylinder casing section and the second cylinder base section together bound a control piston hollow space that is open on one side with an axial control piston hollow space opening. The second cylinder casing section is provided, adjacent to the second cylinder base section, with a (radial) discharge connection (T) opening into the control piston hollow space for connecting to a pressurized medium tank.

The control piston is constructed with corresponding control sections in such a way that the two work connections (A, B) can be connected in a fluid conducting manner through axial displacement of the control piston selectively with the pressure connection (P) and the discharge connection (T). Thus, the first work connection A can be connected to the pressure connection P in a fluid conducting way, while the second work connection B is connected to the discharge connection T in a fluid conducting way. Likewise, the second work connection B can be connected to the pressure connection P in a fluid conducting way. In this way, one of the two pressure chambers of a pressure space of a camshaft adjuster can be connected to a pressurized medium pump via a work connection, while the other pressure chamber of the pressure space is connected via the other work connection to the discharge connection and attached pressurized medium tank, so that the drive part and driven part can be rotated hydraulically. At the same time, the control piston can hydraulically close the two work connections A, B, so that a relative rotational position can be set between the drive part and driven part.

The valve part according to the invention is distinguished essentially in that a cover provided with at least one cover opening (through hole), for example, in the form of a plate-shaped, round cover, is attached to the axial control piston hollow space opening.

If pressurized medium flows inwardly in the radial direction into the control piston hollow space, then it can be advantageously achieved, by the cover contacting the axial control piston hollow space opening for the deflection of the flows of pressurized medium directed inward in the radial direction, that no build-up pressure is exerted on the end face of the valve housing hollow space, as a result of which the control piston was pressurized due to the reaction force. Due to the one or more cover openings in the cover, a hydraulic blocking of the control piston can be prevented for an axial displacement within the valve housing hollow space.

Because pressurized medium between the cover and valve housing hollow space must be pressed through the one or more cover openings when the control piston is displaced in the axial direction toward the end face of the valve housing hollow space, a pressure increase occurs between the cover and valve housing hollow space, which damps the movement of the control piston. Due to this damping effect, the vibration amplitudes of the control piston can be minimized and the stability of the control valve can be improved.

For an advantageous construction of the valve part according to the invention, the cover is provided with a plurality of cover openings, which are arranged adjacent to the cover edge. Here, it is especially advantageous when the openings are arranged distributed uniformly around the cover periphery (cover edge) for a round cover.

The one or more cover openings of the cover can have, for example, a circular hole-shaped or elongated hole-shaped, in particular, slot-shaped construction. Advantageously, the one or more openings are constructed in the form of a recess machined from the cover edge.

An attachment of the cover on the control piston is realized by a suitable attachment mechanism, for example, by a press fit or a catch or snap-on mechanism. Advantageously, the cover is arranged so that it is pressed against the control piston by the spring force of a compression spring loading the control piston against the control element of an actuator.

The invention further extends to a control valve for controlling the pressurized medium, in particular, for a hydraulic camshaft adjuster of an internal combustion engine, which comprises a valve part as described above and an actuator, in particular, in the form of an electromagnet. The actuator comprises a control element, for example, in the form of a tappet, which is in active connection with the control piston of the valve part in such a way that the control piston can be displaced in the axial direction against the spring force of a compression spring.

The invention further extends to a hydraulic camshaft adjuster with a control valve described as above.

BRIEF DESCRIPTION OF THE DRAWINGS

The invention will now be explained in more detail with reference to embodiments, wherein reference is made to the enclosed drawings. Elements that are identical or that have identical functions are designated in the drawings with identical reference symbols. Shown are.

DETAILED DESCRIPTION OF THE PREFERRED EMBODIMENTS

Figure 5:
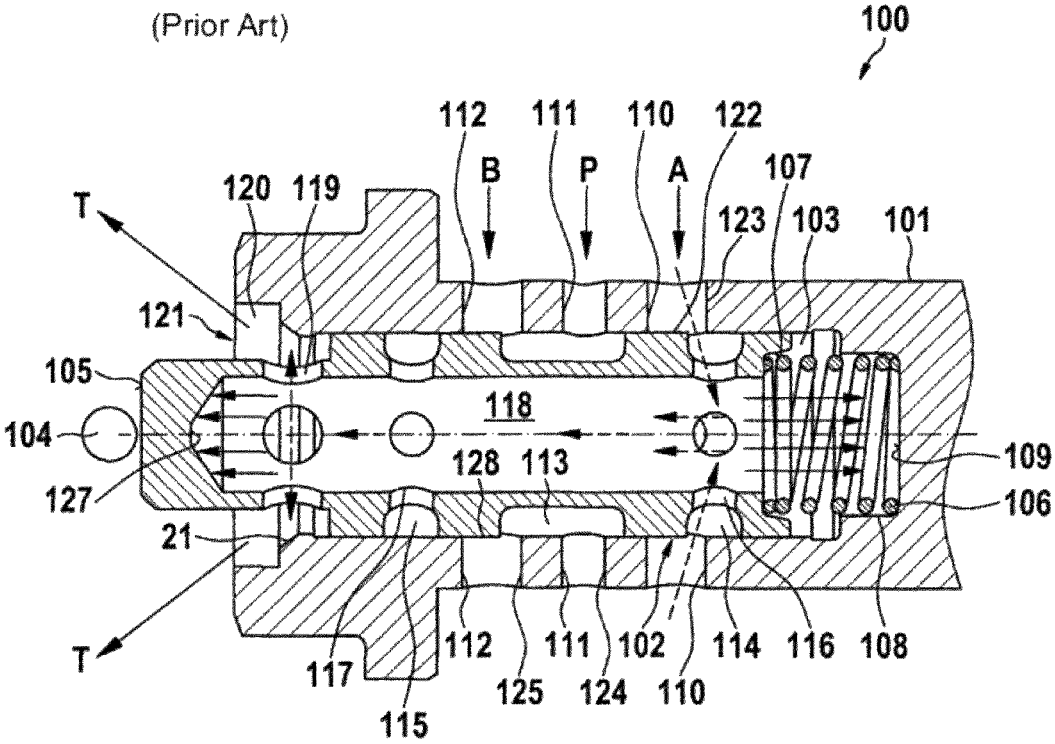
Fig. 5 (Prior Art)
FIG. 5 is an axial section view of a valve part according to the class known in the state of the art of an electromagnetic control valve.

FIG. 5, in which a conventional valve part according to the class of an electromagnetic control valve is shown, was already explained in detail in the introduction of the description, so that the description is not repeated here.

Figure 1:
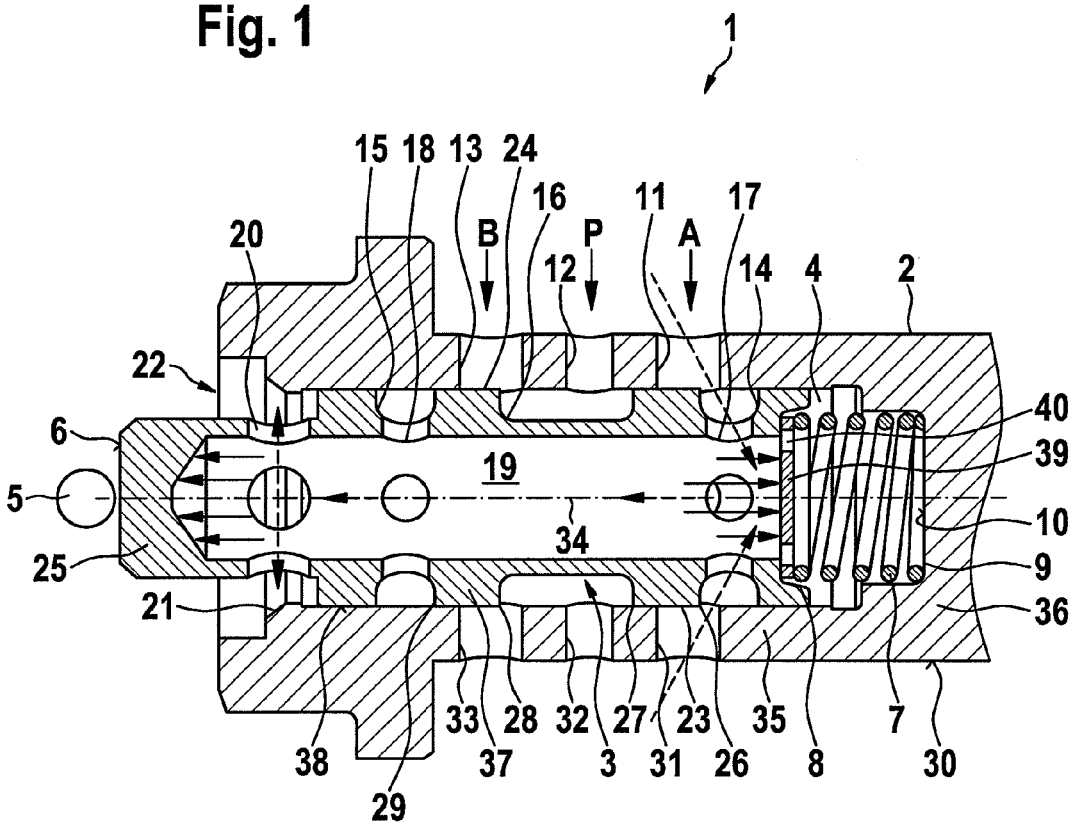
FIG. 1 is an axial section view of a valve part according to an embodiment of the valve part according to the invention.

First, in FIG. 1, a first embodiment of the valve part according to the invention is shown in axial section. The valve part of an electromagnetic control valve designated overall with the reference number 1, in particular, for regulating the pressurized medium of a hydraulic camshaft adjuster of an internal combustion engine, comprises an essentially hollow cylindrical valve housing 2 with a first cylinder casing section 35 arranged in the axial direction (parallel to a cylinder axis 34) and a first cylinder base section 36 extending perpendicular to the cylinder axis 34 as an end section. The first cylinder casing section 35 and the first cylinder base section 36 define a valve housing hollow space 4 open on one side with an axial hollow space opening 22.

Coaxial to the cylinder axis 34, in the valve housing hollow space 4, an essentially hollow cylindrical control piston 3 is held so that it can move in the axial direction. The control piston 3, constructed in the form of a hollow piston, comprises a second cylinder casing section 37 arranged in the axial direction (parallel to a cylinder axis 34) and a second cylinder base section 25, which extends perpendicular to the cylinder axis 34, as an end section. The second cylinder casing section 37 and the second cylinder base section 25 define a control piston hollow space 19 that is open on one side with an axial hollow space opening not shown in more detail in FIG. 1 on the side of the first cylinder base section 36 of the valve housing 2.

A tappet 5, which is shown only partially and which is rigidly attached to a magnetic armature of an electromagnet (electromagnetic actuator) not shown in FIG. 1, contacts the end face 6 at the left in FIG. 1 of the second cylinder base section 25 of the control piston 3. When the magnetic armature is energized, the tappet 5 is displaced in the axial direction relative to the valve part 1 and here displaces the control piston 3 in the axial direction against the spring force of a compression spring 7. For this purpose, on one end the compression spring 7 contacts the end of the control piston 3 away from the tappet and is held in an axial first ring step 8 of the control piston 3 expanding in the radial direction. On its other end, the compression spring 7 is held in an axial, second ring step 9 of the valve housing hollow space 4 and is supported on an end face 10 of the first cylinder base section 36 of the valve housing 2 oriented perpendicular to the axial direction 40. The compression spring 7 is here constructed as a helical spring, but can also be any other suitable spring type. If the magnetic armature is not energized, so that the tappet 5 is not activated by the electromagnet, then the compression spring 7 restores the position of the control piston 3 (to the left in FIG. 1).

In the first outer casing surface 30 of the first cylinder casing section 35 of the valve housing 2, three peripheral ring grooves spaced apart from each other in the axial direction are machined, namely a first ring groove 31, a second ring groove 32, and a third ring groove 33. In the first ring groove 31, distributed uniformly around the periphery, first radial boreholes 11 are machined. Likewise, in the second ring groove 32, distributed uniformly around the periphery, second radial boreholes 12 are machined and, in the third ring groove 33, distributed uniformly around the periphery, third radial boreholes 13 are machined. The first, second, and third radial boreholes each open into the valve housing hollow space 4. In the axial section shown in FIG. 1, the ring grooves each transition directly into the radial boreholes, so that no difference can be seen in the drawing between the ring grooves and radial boreholes.

As indicated by the arrows, the first ring groove 31 with the first radial boreholes 11 is used as a first work connection A, the second ring groove 32 with the second radial boreholes 12 is used as the pressure connection P, and the third ring groove 33 with the third radial boreholes 13 is used as the second work connection B.

In the second outer casing surface 38 of the second cylinder casing section 37 of the control piston 3, three peripheral ring grooves spaced apart from each other in the axial direction are machined, namely a fourth ring groove 14, a fifth ring groove 15, and a sixth ring groove 16 located between the fourth and the fifth ring groove. In the fourth ring groove 14, distributed uniformly around the periphery, fourth radial boreholes 17 are machined, which each opening into the control piston hollow space 19. The sixth ring groove 16 is used, according to the position of the control piston 3, as a pressurized medium channel for connecting the first radial boreholes 11 to the second radial boreholes 12 or the third radial boreholes 13 to the second radial boreholes 12.

In the second cylinder casing section 37 of the control piston 3, sixth radial boreholes 20 are formed, which open into the control piston hollow space 19 on the tappet side of the fifth ring groove 15 bordering the second cylinder base section 25 of the control piston 3. Through use of the sixth radial boreholes 20, the control piston hollow space 19 is opened at the outer side of the control piston 3, wherein the sixth radial boreholes 20 opening into a third ring step 21 of the valve housing hollow space 4 are used as the discharge connection T.

In the connection assignment shown in FIG. 1, through use of the fourth, fifth, and sixth ring grooves 14-16, as well as the fourth radial boreholes 17 machined into the fourth ring groove 14 and the fifth radial boreholes 18 machined into the fifth ring groove 15, according to the axial position of the control piston 3, the first work connection A and the second work connection B are selectively connected or separated in a fluid conducting way to the pressure connection P or to the tank connection T. In FIG. 1, a position of the control piston 3 is shown, in which the first work connection A is connected in a fluid conducting way to the tank connection T and the second work connection B is connected in a fluid conducting way to the pressure connection P. If the control piston 3 is displaced by the effect of the tappet 5 even farther in the axial direction against the spring force of the compression spring 7 (to the right in FIG. 1), the second work connection B can be connected in a fluid conducting way to the tank connection T and the first work connection A to the pressure connection P. At the same time, the control piston 3 can be brought into an intermediate position, in which neither of the two work connections A, B are connected in a fluid conducting way to the pressure connection P or to the tank connection T.

Adjacent to the sixth ring groove 16, a first ring bar 23 and a second ring bar 24 are formed, which are used, in particular, for the axial guidance of the control piston 3 within the valve housing 2. The peripheral surfaces of the two ring bars 23, 24 are shaped so that they can cover or open the first radial boreholes 11 or the third radial boreholes 13 in a sealing manner when the control piston 3 is shifted in the axial direction, in order to regulate in this way the flow rate of pressurized medium (for example, oil) by a change in the cross sections of the openings. Adjusting the cross sections of the openings of the first radial boreholes 11 or the third radial boreholes 13 is realized by control edges of the two ring bars 23, 24, namely a first control edge 26 away from the tappet and a second control edge 27 of the first ring bar 23 facing the tappet or a third control edge 28 away from the tappet and a fourth control edge 29 of the second ring bar 24 facing the tappet.

In the valve part 1 shown in FIG. 1, a plate-shaped, round cover 39 is arranged on the axial hollow space opening of the control piston hollow space 19. The cover 39 covers the axial hollow space opening of the control piston hollow space 19 completely and is held, for this purpose, in the first ring step of the control piston 3. The cover 39 is pressed by the pressure force of the compression spring 7 against the control piston 3.

In the cover 39, a plurality of cover openings 40 penetrating through the cover 39 are formed. Through the cover openings 40, the control piston hollow space 19 is connected in a fluid conducting way to the part of the valve housing hollow space located on the side of the cover 39 away from the tappet.

Figure 2:
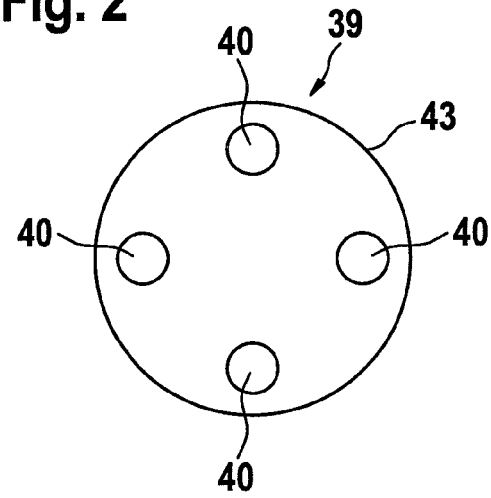
FIG. 2 is a perspective view of an embodiment of the cover of the valve part of FIG. 1.

In FIG. 2, the round cover 39 of FIG. 1 is shown enlarged in a perspective view. Accordingly, this is provided with four circular cover openings 40, which are arranged in a uniform distribution around the periphery of the cover 39. The circular cover openings 40 are located in the vicinity of (next to) the cover edge (outer periphery) 43.

In the position of the control piston 3 shown in FIG. 1, in which the first work connection A is connected in a fluid conducting way to the tank connection T, pressurized medium can flow via the first radial boreholes 11 and the fourth radial boreholes 17 into the control piston hollow space 19. The flows of pressurized medium directed inwardly in the radial direction are deflected into an axial flow of pressurized medium, which is directed toward the second cylinder base section 25 and which flows essentially in the center of the control piston hollow space 19. Due to the cover 39 attached to the control piston 3 via the spring force of the compression spring 7, the pressurized medium is prevented from striking the end face 10 of the valve housing hollow space 4 when the pressurized medium is deflected into axial flow, so that a resulting reaction force is prevented on the control piston 3, which would apply a load on the control piston 3 in the same direction as the spring force of the compression spring 7. Because the flow of pressurized medium essentially strikes the cover 39 in the center, through the cover openings 40 positioned close to the cover edge 32, the pressurized medium is prevented from flowing through the cover openings 40 into the section of the valve housing hollow space 4 located on the side of the cover 39 away from the tappet.

Through use of the cover openings 40, for an axial displacement of the control piston 3 in the direction toward the end face 10 of the valve housing hollow space 3, pressurized medium can flow between the cover 39 and the valve housing hollow space 4, wherein, through the flow resistance, advantageously an increase in pressure between the cover 39 and the valve housing hollow space 4 occurs, which damps the movement of the control piston 3, minimizes the vibration amplitudes of the control piston 3, and improves the stability of the control valve. Through a change in the cross sections of the cover openings 40, the flow resistance can be adjusted in the desired way.

Figure 3:
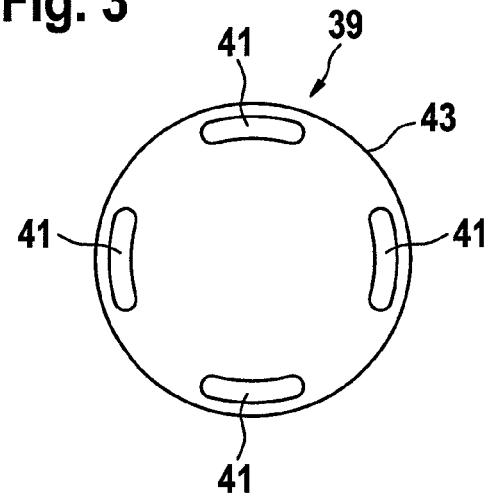
FIG. 3 is a perspective view of a variant of the cover of the valve part.

FIG. 3 shows a variant of the round cover 39, which can be used similarly in the valve part of FIG. 1. Here, the cover openings 41 have an elongated hole-like construction.

Figure 4:
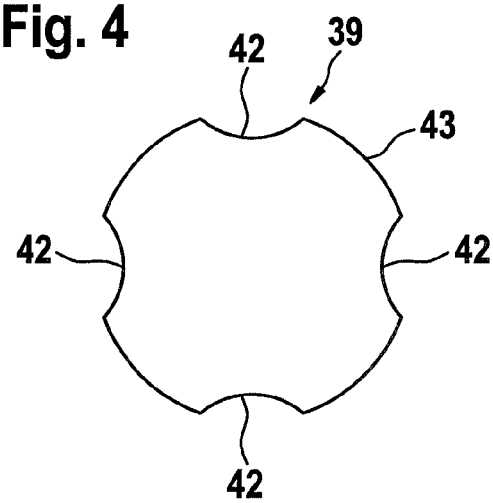
FIG. 4 is a perspective view of another variant of the cover of the valve part.

FIG. 4 shows another variant of the round cover 39, which can also be used in the valve part of FIG. 1. Here, the cover openings are constructed in the form of recesses 42, which are machined into the cover edge 43.

Although a displacement mechanism is shown in the embodiments, in which the control piston 2 is displaced by a tappet 5 activated by an electromagnet, a different actuator could also be provided for activating the tappet 5, such as, for example, an electric servomotor.

Although the valve part and the associated control valve were described in the use for controlling the pressurized medium in a camshaft adjuster of an internal combustion engine, the valve part or control valve could be used at the same time for controlling flows of pressurized medium in other devices.

LIST OF REFERENCE SYMBOLS

1 Valve part
2 Valve housing
3 Control piston
4 Valve housing hollow space
5 Tappet
6 End face
7 Compression spring
8 First ring step
9 Second ring step
10 End face
11 First radial boreholes
12 Second radial boreholes
13 Third radial boreholes
14 Fourth ring groove
15 Fifth ring groove
16 Sixth ring groove
17 Fourth radial boreholes
18 Fifth radial boreholes
19 Control piston hollow space
20 Sixth radial boreholes
21 Third ring step
22 Hollow space opening
23 First ring bar
24 Second ring bar
25 Second cylinder base section
26 First control edge
27 Second control edge
28 Third control edge
29 Fourth control edge
30 First outer casing surface
31 First ring groove
32 Second ring groove
33 Third ring groove
34 Cylindrical axis
35 First cylinder casing section
36 First cylinder base section
37 Second cylinder casing section
38 Second outer casing surface
39 Cover
40 Circular hole-shaped cover opening
41 Elongated hole-shaped cover opening
42 Recess
43 Cover edge
100 Valve part
101 Valve housing
102 Control piston
103 Valve housing hollow space
104 Tappet
105 End face
106 Compression spring
107 First ring step
108 Second ring step
109 First end face
110 First radial boreholes
111 Second radial boreholes
112 Third radial boreholes
113 Sixth ring groove
114 Fourth ring groove
115 Fifth ring groove
116 Fourth radial boreholes
117 Fifth radial boreholes
118 Control piston hollow space
119 Sixth radial boreholes
120 Third ring step
121 Hollow space opening
122 First ring bar
123 First ring groove
124 Second ring groove
125 Third ring groove
127 Second end face
128 Second ring bar

The invention claimed is:

1. Valve part of a control valve for controlling flows of pressurized medium, comprising:

a cylindrical valve housing with a valve housing hollow space that is open on one side in an axial direction, the valve housing is provided with a radial first work connection, a radial second work connection, and a radial pressure connection, each of which open into the valve housing hollow space, a cylindrical control piston is held in the valve housing hollow space so that it can move in the axial direction and includes a control piston hollow space that is open on one side at an axial control piston hollow space opening, and at an opposite side the control piston includes a closed axial end face adapted to be acted upon by an actuator, and the control piston is provided with radial boreholes that are moveable into communication with the first and second radial work connections, and a radial discharge connection opening adjacent to the closed axial end face that opens into the control piston hollow space, the control piston is constructed such that the work connections can be connected selectively in a fluid conducting way to the pressure connection and the discharge connection via the radial boreholes through axial displacement of the control piston, and a cover is attached to the axial control piston hollow space opening, the cover having a plurality of cover openings, which are arranged adjacent to a cover edge, and the cover having a solid center area that is adapted to be contacted by a flow of pressure medium into the control piston hollow space through the radial boreholes to prevent a resulting reaction force on the control piston.

2. Valve part according to claim 1, wherein the cover has a round shape and the cover openings are arranged distributed uniformly around the cover edge.

3. Valve part according to claim 1, wherein the at least one cover opening has a circular hole-shaped construction.

4. Valve part according to claim 1, wherein the at least one cover opening has an elongated hole-shaped construction.

5. Valve part according to claim 1, wherein the at least one cover opening is constructed as a recess machined into a cover edge.

6. Valve part according to claim 1, wherein the cover is attached to the control piston with a press fit, catch or snap-on mechanism.

7. Valve part according to claim 1, wherein the cover is pressed against the control piston by a spring force of a compression spring applying a load on the control piston against an adjustment element of the actuator.

8. Control valve comprising an actuator and a valve part, the valve part including a cylindrical valve housing with a valve housing hollow space that is open on one side in an axial direction, the valve housing is provided with a radial first work connection, a radial second work connection, and a radial pressure connection, each of which open into the valve housing hollow space, a cylindrical control piston is held in the valve housing hollow space so that the control piston can move in the axial direction and includes a control piston hollow space that is open on one side at an axial control piston hollow space opening, and at an opposite side the control piston includes a closed axial end face adapted to be acted upon by an actuator, and the control piston is provided with radial boreholes that are moveable into communication with the first and second radial work connections, and a radial discharge connection opening adjacent to the closed axial end face that opens into the control piston hollow space, the control piston is constructed such that the work connections can be connected selectively in a fluid conducting way to the pressure connection and the discharge connection via the radial boreholes through axial displacement of the control piston, and a cover is attached to the axial control piston hollow space opening, the cover having a plurality of cover openings, which are arranged adjacent to a cover edge, and the cover having a solid center area that is adapted to be contacted by a flow of pressure medium into the control piston hollow space through the radial boreholes to prevent a resulting reaction force on the control piston.

9. Camshaft adjuster comprising a control valve, the control valve including an actuator and a valve part, the valve part including a cylindrical valve housing with a valve housing hollow space that is open on one side in an axial direction, the valve housing is provided with a radial first work connection, a radial second work connection, and a radial pressure connection, each of which open into the valve housing hollow space, a cylindrical control piston is held in the valve housing hollow space so that the control piston can move in the axial direction and includes a control piston hollow space that is open on one side at an axial control piston hollow space opening, and at an opposite side the control piston includes a closed axial end face adapted to be acted upon by an actuator, and the control piston is provided with radial boreholes that are moveable into communication with the first and second radial work connections, and a radial discharge connection opening adjacent to the closed axial end face that opens into the control piston hollow space, the control piston is constructed such that the work connections can be connected selectively in a fluid conducting way to the pressure connection and the discharge connection via the radial boreholes through axial displacement of the control piston, and a cover is attached to the axial control piston hollow space opening, the cover having a plurality of cover openings, which are arranged adjacent to a cover edge, and the cover having a solid center area that is adapted to be contacted by a flow of pressure medium into the control piston hollow space through the radial boreholes to prevent a resulting reaction force on the control piston.

* * * * *